US009346270B2

(12) United States Patent
Takabe et al.

(10) Patent No.: US 9,346,270 B2
(45) Date of Patent: May 24, 2016

(54) LIQUID EJECTING HEAD AND LIQUID EJECTING APPARATUS

(71) Applicant: SEIKO EPSON CORPORATION, Tokyo (JP)

(72) Inventors: Motoki Takabe, Shiojiri (JP); Eiju Hirai, Minowa-machi (JP); Yoichi Naganuma, Matsumoto (JP); Shunya Fukuda, Azumino (JP); Akira Miyagishi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/835,219

(22) Filed: Aug. 25, 2015

(65) Prior Publication Data

US 2016/0059558 A1 Mar. 3, 2016

(30) Foreign Application Priority Data

Sep. 1, 2014 (JP) ..... 2014-176997

(51) Int. Cl.
*B41J 2/045* (2006.01)
*B41J 2/14* (2006.01)

(52) U.S. Cl.
CPC ..... *B41J 2/14233* (2013.01)

(58) Field of Classification Search
CPC ..... B41J 2/055; B41J 2/1433; B41J 2/14233; B41J 2/14301; B41J 2/14274; B41J 2/1607; B41J 2/1612
See application file for complete search history.

(56) References Cited

U.S. PATENT DOCUMENTS 8,083,328 B2 * 12/2011 Kitahara ..... B41J 2/14314 347/55
2007/0058005 A1 3/2007 Kanaya
2011/0221832 A1 9/2011 Shimada
2012/0212547 A1 8/2012 Takemoto et al.
2013/0127955 A1 5/2013 Ataka et al.

FOREIGN PATENT DOCUMENTS

EP 1733883 12/2006
JP 2011-131571 7/2011
JP 2011-140173 A 7/2011

OTHER PUBLICATIONS

European Search Report for Application No. 15182385.3 dated Jan. 14, 2016.

* cited by examiner

*Primary Examiner* — Juanita D Jackson
(74) *Attorney, Agent, or Firm* — Workman Nydegger

(57) ABSTRACT

A liquid ejecting head includes a pressure chamber substrate where a plurality of spaces to be a pressure chamber along a Y direction are formed in an X direction, a vibration plate that seals the space by being stacked in the pressure chamber substrate, and a piezoelectric element and a supporting unit that are stacked in the vibration plate on an opposite side to the pressure chamber substrate, in which positions at one end in the Y direction are different from each other in a first space and a second space among the plurality of spaces, and the supporting unit suppresses a vibration of the vibration plate by being formed so as to overlap with at least the one end side portion in the first space in a planar view.

12 Claims, 17 Drawing Sheets

LIQUID EJECTING HEAD AND LIQUID EJECTING APPARATUS

CROSS-REFERENCE TO RELATED APPLICATIONS

The present application claims priority to Japanese Patent Application No. 2014-176997 filed on Sep. 1, 2014, which is hereby incorporated by reference in its entirety.

BACKGROUND

1. Technical Field

The present invention relates to a technology of ejecting a liquid such as an ink.

2. Related Art

In the past, various types of technologies of ejecting a liquid such as an ink onto a medium such as printing paper have been offered. For example, in JP-A-2011-140173, a liquid discharge head where a first pressurized liquid chamber and a second pressurized liquid chamber of which full lengths from a common liquid chamber are different from each other are alternately arrayed, is disclosed. In a configuration of JP-A-2011-140173, the first pressurized liquid chamber and the second pressurized liquid chamber are controlled into flow path properties which are the same to each other, by the configuration that positions and shapes of narrowing units which apply flow path resistance to the ink by being formed on a downstream side of the common liquid chamber in the first pressurized liquid chamber and the second pressurized liquid chamber are different from each other.

However, in the configuration of controlling the flow path properties of the first pressurized liquid chamber and the second pressurized liquid chamber depending on the position and the shape of the narrowing unit within a flow path as the configuration of JP-A-2011-140173, since a structure of the flow path reaching a nozzle through each pressurized liquid chamber from the common liquid chamber is complicated, there is a problem that the formation of the flow path is not actually easy. Specifically, the flow path of the same flow path properties is unlikely to be formed in the first pressurized liquid chamber and the second pressurized liquid chamber on the basis of the configuration that the positions and the shapes of the narrowing units are different from each other.

SUMMARY

An advantage of some aspects of the invention is to control flow path properties of a pressure chamber by a simple configuration.

According to an aspect of the invention, there is provided a liquid ejecting head including: a pressure chamber substrate where a plurality of spaces to be a pressure chamber along a first direction are formed in a second direction which is perpendicular to the first direction; a vibration plate that seals the space by being stacked in the pressure chamber substrate; and a piezoelectric element and a vibration restraint unit that are stacked in the vibration plate on an opposite side to the pressure chamber substrate, wherein positions at one end in the first direction are different from each other in a first space and a second space among the plurality of spaces, and the vibration restraint unit suppresses a vibration of the vibration plate by being formed so as to overlap with at least the one end side portion in the first space in a planar view.

In the above configuration, since the vibration restraint unit is stacked in the vibration plate so as to overlap with at least the one end side portion in the first space in the planar view, the vibration (capacity change of the pressure chamber) of the portion correlating with the one end of the first space among the vibration plate is suppressed. Therefore, there is an advantage that the flow path properties (for example, excluded volume) of the pressure chamber can be controlled by the simple configuration, in comparison with the configuration of JP-A-2011-140173 of controlling the flow path properties of each pressurized liquid chamber by making the positions of the narrowing units be different from each other within the flow path. In a first aspect of the invention, the vibration restraint unit overlaps with the one end side portion in the first space, and does not overlap with the second space in the planar view. Moreover, in a second aspect, the vibration restraint unit overlaps with the one end side portion in both of the first space and the second space in the planar view.

In the liquid ejecting head according to above aspect, an excluded volume is aligned by the vibration restraint unit, in the first space and the second space. In the above aspects, there is the advantage that the excluded volume of the first space and the excluded volume of the second space can be equalized by the simple configuration of suppressing the vibration due to the vibration restraint unit. Furthermore, the excluded volume means a change amount (capacity change amount) of the volume of the pressure chamber by the vibration of the vibration plate.

In the liquid ejecting head according to above aspect, positions at the other end in the first direction are the same to each other, in the first space and the second space. In the above aspects, since the positions at the other end in the first direction are common in the first space and the second space, there is the advantage that the structure of the flow path for supplying the liquid to each space is simplified. On the other hand, the capacities are different from each other by making the positions at the one end be different from each other in the first space and the second space, but as described above, the excluded volumes can be equalized in the first space and the second space, by the simple configuration of suppressing the vibration due to the vibration restraint unit.

In the liquid ejecting head according to above aspect, the piezoelectric element includes an upper electrode, a piezoelectric body layer, and a lower electrode, and the vibration restraint unit includes a metal layer which is stacked in the upper electrode. In the above aspects, since the metal layer which contributes to the lowering of the resistance by being stacked in the upper electrode is used as a vibration restraint unit, there is the advantage that the configuration of the liquid ejecting head is simplified, in comparison with a case where an element which is dedicated to suppressing the vibration of the vibration plate is used as a vibration restraint unit.

In the liquid ejecting head according to above aspect, the vibration restraint unit includes a protection member that has an accommodation place where the piezoelectric element is displaceable on an inside, and is stacked in the vibration plate so as to cover the piezoelectric element. In the above aspects, since the protection member which protects the piezoelectric element is used as a vibration restraint unit, there is the advantage that the configuration of the liquid ejecting head is simplified, in comparison with the case where the element which is dedicated to suppressing the vibration of the vibration plate is used as a vibration restraint unit.

In the liquid ejecting head according to above aspect, the liquid ejecting head further including: a communication plate that is stacked in the pressure chamber substrate on an opposite side to the vibration plate, and has a communication hole communicating with the space and a nozzle on the one end side, wherein a flow path diameter of the communication hole is greater than the space in the second direction, and one end of the communication hole is positioned on an outside of the space in the first direction. In the above aspects, since the flow path that reaches the nozzle through the communication hole of which the flow path diameter is enlarged in comparison with the space is formed on the downstream side of the space, the flow path resistance on the downstream side of the space is reduced, in comparison with the configuration that the flow path diameter of the communication hole is less than the flow path diameter of the space. Therefore, the liquid within the space can smoothly flow into the nozzle.

A liquid ejecting apparatus according to another suitable aspect of the invention, includes the liquid ejecting head according to each aspect described above. A good example of the liquid ejecting head is the printing apparatus of ejecting the ink, but usefulness of the liquid ejecting apparatus according to the aspect of the invention is not limited to the printing.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
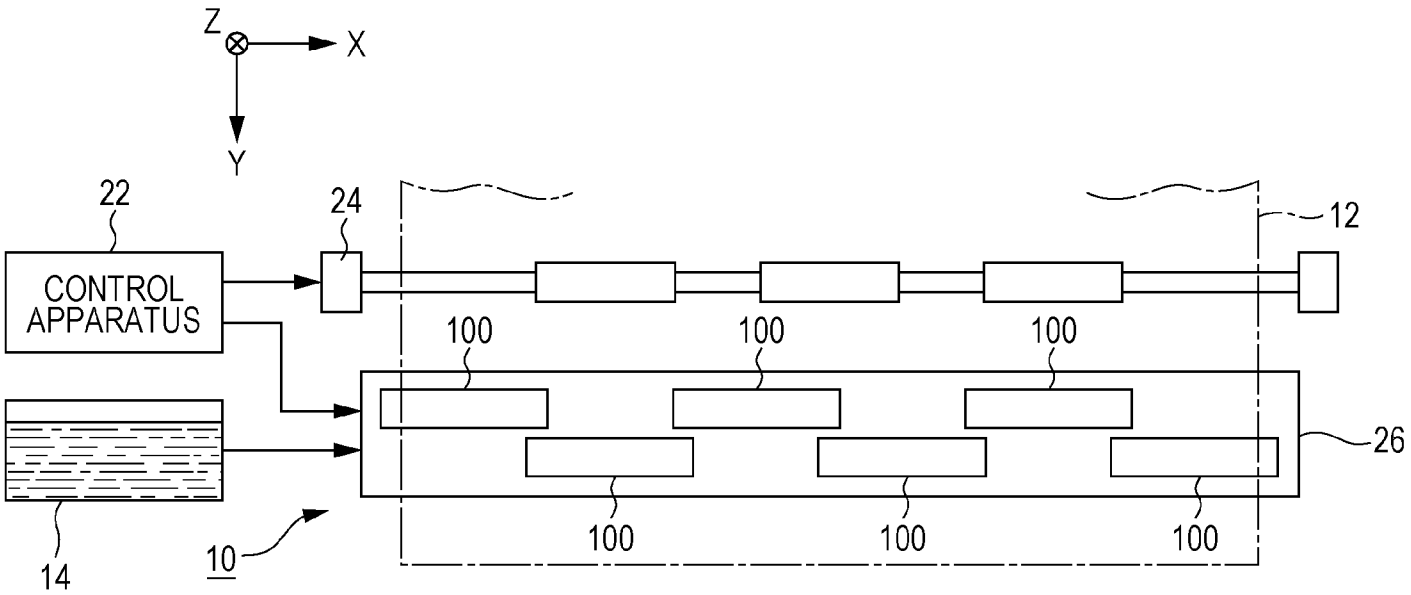
FIG. 1 is a configuration diagram of a printing apparatus according to a first embodiment of the invention.

FIG. 1 is a partial configuration diagram of an ink jet type printing apparatus 10 according to a first embodiment of the invention. The printing apparatus 10 of the first embodiment is a liquid ejecting apparatus of ejecting an ink being an example of a liquid onto a medium (ejecting target) 12 such as printing paper, and includes a control apparatus 22, a transport mechanism 24, and a liquid ejecting module 26. A liquid container (cartridge) 14 accommodating the ink is mounted on the printing apparatus 10.

The control apparatus 22 controls overall the respective elements of the printing apparatus 10. The transport mechanism 24 transports the medium 12 in a Y direction, based on the control by the control apparatus 22. The liquid ejecting module 26 includes a plurality of liquid ejecting heads 100. The liquid ejecting module 26 of the first embodiment is a line head where the plurality of liquid ejecting heads 100 are arrayed (so-called zigzag arrangement or so-called staggered arrangement) along an X direction intersecting with (which is typically orthogonal to) the Y direction. Each liquid ejecting head 100 ejects the ink which is supplied from the liquid container 14 onto the medium 12, based on the control by the control apparatus 22. Each liquid ejecting head 100 forms a desired image on a surface of the medium 12 by ejecting the ink onto the medium 12 in parallel with the transport of the medium 12 by the transport mechanism 24. Hereinafter, a direction that is perpendicular to an X-Y plane (plane which is parallel to the surface of the medium 12) is designated as a Z direction. An ejecting direction (downward side of a vertical direction) of the ink by each liquid ejecting head 100 correlates with the Z direction.

Figure 2:
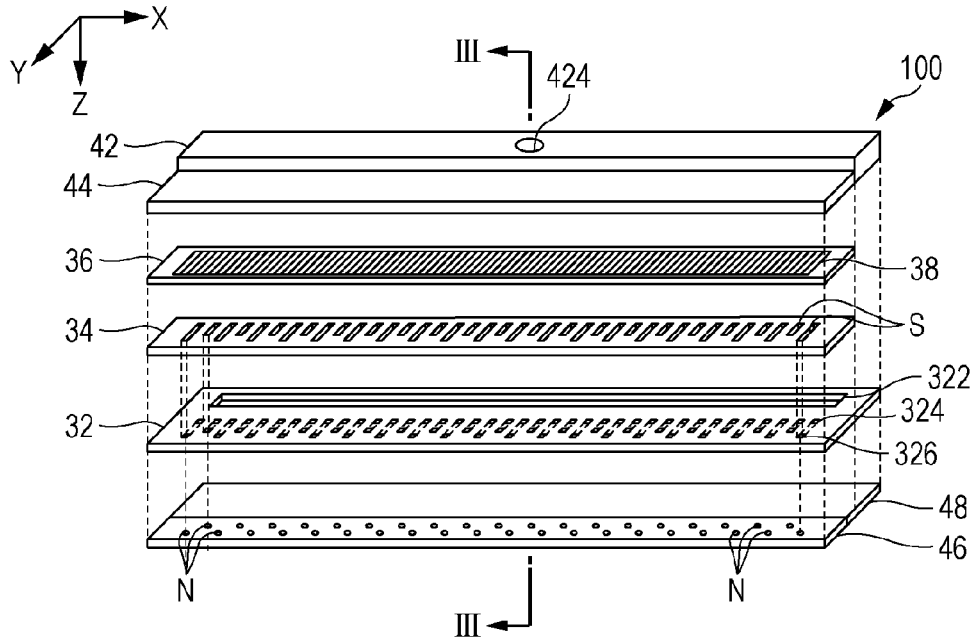
FIG. 2 is an exploded perspective view of a liquid ejecting head.
Figure 3:
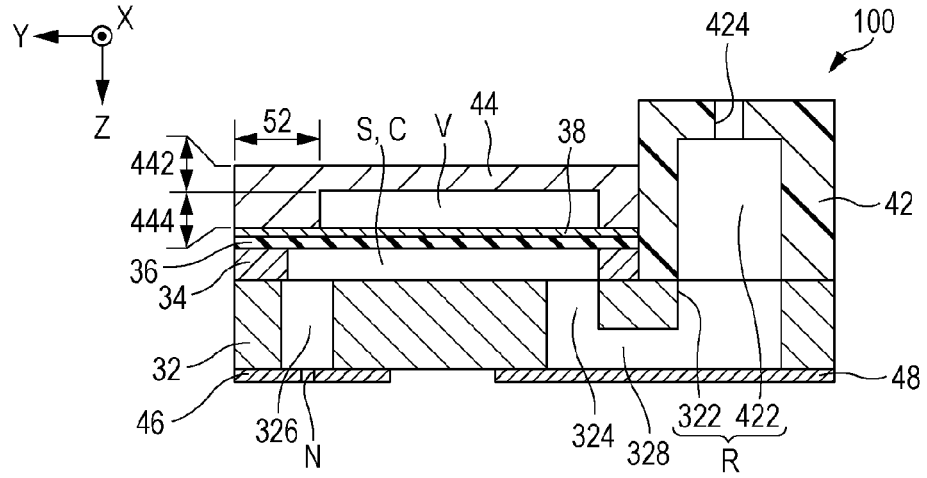
FIG. 3 is a sectional view of the liquid ejecting head.

FIG. 2 is an exploded perspective view of any one of the liquid ejecting heads 100. FIG. 3 is a sectional (section which is parallel to a Y-Z plane) view taken along III-III line in FIG. 2. As illustrated in FIG. 2 and FIG. 3, the liquid ejecting head 100 of the first embodiment is a structure where a pressure chamber substrate 34, a vibration plate 36, a case 42, and a protection member 44 are installed on a negative side plane of the Z direction among a communication plate 32, and a nozzle plate 46 and a compliance unit 48 are installed on a positive side plane of the Z direction among the communication plate 32. The respective elements of the liquid ejecting head 100 are almost flat plate-shaped members which are schematically long in the X direction, and are joined to each other, for example, by using an adhesive.

Figure 4:
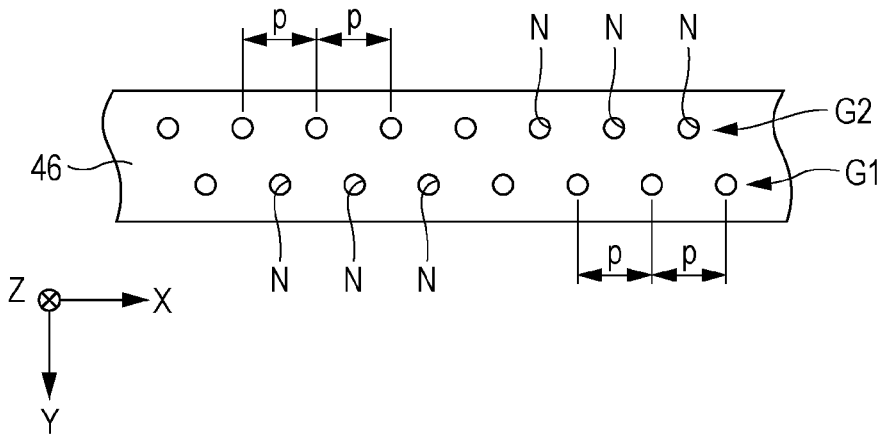
FIG. 4 is a plan view of a nozzle plate.

FIG. 4 is a plan view of the nozzle plate 46 when seen from the negative side (communication plate 32 side) of the Z direction. As illustrated in FIG. 2 to FIG. 4, the nozzle plate 46 of the first embodiment is a flat plate where a plurality of nozzles (ejecting holes) N are formed, and is fixed on the surface of the positive side of the Z direction among the communication plate 32, for example, by using the adhesive. The plurality of nozzles N are arrayed along the X direction. As illustrated in FIG. 4, the plurality of nozzles N of the first embodiment are divided into a first nozzle array G1 and a second nozzle array G2 which are arrayed in parallel at intervals to each other in the Y direction. The first nozzle array G1 is positioned on the positive side of the Y direction with respect to the second nozzle array G2.

Each of the first nozzle array G1 and the second nozzle array G2 is a set of the plurality of nozzles N which are arrayed by a predetermined pitch p along the X direction. Positions of the respective nozzles N in the X direction are different from each other in the first nozzle array G1 and the second nozzle array G2. Specifically, the respective nozzles N of the second nozzle array G2 are positioned in the middle of the respective nozzles N of the first nozzle array G1 which are adjacent to each other in the X direction. That is, the plurality of nozzles N are arrayed (so-called staggered arrangement) into a zigzag shape along the X direction.

Figure 5:
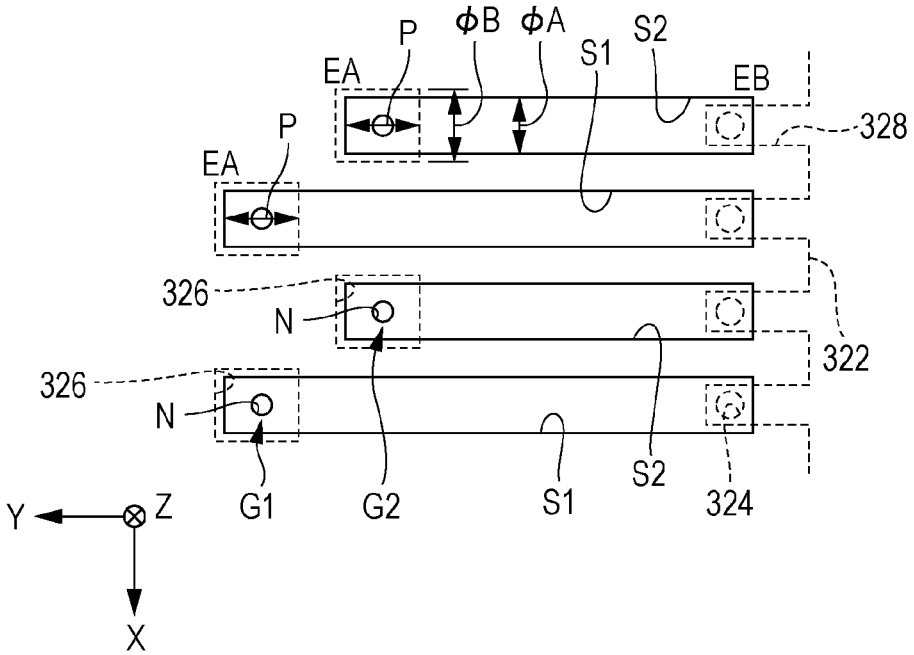
FIG. 5 is a plane view of a pressure chamber substrate.

FIG. 5 is a plan view of the pressure chamber substrate 34. As illustrated in FIG. 2 and FIG. 5, the pressure chamber substrate 34 of the first embodiment is a flat plate where a plurality of spaces S (S1, S2) to be a pressure chamber (cavity) are formed. The plurality of spaces S are arrayed along the X direction (second direction) so as to correlate with the respective nozzles N. Each of the plurality of spaces S is a through hole along the Y direction (first direction) in a planar view. Specifically, as illustrated in FIG. 5, each space S is formed into a long shape which is extended along the Y direction in the planar view, throughout one end (referred to as "first end", hereinafter) EA of the positive side of the Y direction and the other end (referred to as "second end", hereinafter) EB of the negative side. Although a material and a manufacturing method of the pressure chamber substrate 34 are arbitrary, for example, by selectively removing a substrate which is formed of a silicon single crystal due to a semiconductor manufacturing technology such as an etching, it is possible to form the pressure chamber substrate 34 of the intended shape simply and highly accurately.

As illustrated in FIG. 5, the plurality of spaces S which are formed in the pressure chamber substrate 34 are divided into a plurality of first spaces S1 and a plurality of second spaces S2. The first space S1 and the second space S2 are alternately arrayed along the X direction. If being focused on a portion (referred to as "end unit", hereinafter) P which is positioned on the first end EA side among each space S in the planar view, the end unit P of the first space S1 overlaps with one nozzle N of the first nozzle array G1 in the planar view, and the end unit P of the second space S2 overlaps with one nozzle N of the second nozzle array G2 in the planar view. As described above with reference to FIG. 4, since the first nozzle array G1 is positioned on the positive side of the Y direction with respect to the second nozzle array G2, the first end EA of the first space S1 is positioned on the positive side in the Y direction in comparison with the first end EA of the second space S2. That is, the positions at the first end EA in the Y direction are different from each other in the first space S1 and the second space S2. On the other hand, the positions at the second end EB in the Y direction are common in the first space S1 and the second space S2. That is, as illustrated in FIG. 5, the second end EB of each first space S1 and the second end EB of each second space S2 are positioned on a straight line which is parallel to the X direction. As understood from the above description, the full lengths (distances between the first end EA and the second end EB) of the first space S1 and the second space S2 are different from each other in the Y direction. Furthermore, a flow path diameter (width) $\phi A$ of each space S in the X direction is the same in the first space S1 and the second space S2.

The communication plate 32 of FIG. 2 is a flat plate for forming a flow path. As illustrated in FIG. 2, an opening unit 322, a plurality of supply holes 324, and a plurality of communication holes 326 are formed in the communication plate 32 of the first embodiment. As illustrated in FIG. 2, the opening unit 322 is a through hole which is formed into a long shape along the X direction in the planar view, so as to continue throughout the plurality of nozzles N. On the other hand, the supply hole 324 and the communication hole 326 are through holes which are individually formed per the nozzle N. Moreover, as illustrated in FIG. 3, a groove-shaped branch path (manifold) 328 which is extended in Y direction is formed per the supply hole 324 on the surface of the positive side (opposite side to the pressure chamber substrate 34) of the Z direction among the communication plate 32, so as to communicate with the supply hole 324 and the opening unit 322. Although the material and the manufacturing method of the communication plate 32 are arbitrary, for example, in the same manner as the pressure chamber substrate 34 as described above, by selectively removing a substrate which is formed of the silicon single crystal due to the semiconductor manufacturing technology, it is possible to form the communication plate 32 of the intended shape simply and highly accurately.

In FIG. 5, the shape of the communication plate 32 is written by a broken line. As illustrated in FIG. 5, each supply hole 324 of the communication plate 32 is formed per the space S, so as to overlap with a region of the second end EB side among the respective spaces S (S1, S2) of the pressure chamber substrate 34 in the planar view. As described above, since the positions at the second end EB in the Y direction are common in the first space S1 and the second space S2, the plurality of supply holes 324 of the communication plate 32 are arrayed into a straight line shape along the X direction. As understood from the above description, the flow path of the ink which branches off into each branch path 328 from the opening unit 322 of the communication plate 32 and reaches the space S through the supply hole 324 of a downstream side, is individually formed per the nozzle N.

On the other hand, each communication hole 326 is formed per the space S, so as to overlap with the end unit P of the first end EA side among the respective spaces S (S1, S2) of the pressure chamber substrate 34 in the planar view. Therefore, the respective spaces S of the pressure chamber substrate 34 communicate with the nozzle N through the communication hole 326. Specifically, as understood from FIG. 5, the first space S1 communicates with the nozzles N of the first nozzle array G1 through the communication hole 326, and the second space S2 communicates with the nozzle N of the second nozzle array G2 through the communication hole 326. As described above, the positions (positions of the end units P) at the first end EA in the Y direction are different from each other in the first space S1 and the second space S2, the position of the communication hole 326 correlating with the first space S1 and the position of the communication hole 326 correlating with the second space S2 are different from each other in the Y direction. Specifically, each communication hole 326 correlating with the first space S1 is positioned on the positive side of the Y direction with respect to each communication hole 326 correlating with the second space S2. That is, the plurality of communication holes 326 are arrayed (zigzag arrangement or staggered arrangement) into two arrays correlating with the first space S1 and the second space S2 along the X direction.

As illustrated in FIG. 5, a flow path diameter $\phi B$ of the communication hole 326 in the X direction is greater than the flow path diameter $\phi A$ of the space S in the X direction ($\phi B > \phi A$). Moreover, one end of the positive side of the Y direction among the communication hole 326 is positioned on an outside of each space S in the planar view. That is, a margin (inner wall plane) of the positive side of the Y direction among the communication hole 326 is positioned on the positive side of the Y direction when seen from the first end EA of the space S correlating with the communication hole 326. As understood from the above description, the flow path that reaches the nozzle N through the communication hole 326 of which the flow path diameter is enlarged in comparison with the space S, is formed on the downstream side of the space S. Therefore, the flow path resistance on the downstream side of the space S is reduced, in comparison with the configuration that the flow path diameter ϕB of the communication hole 326 is less than the flow path diameter ϕA of the space S, and the ink within the space S may smoothly flow into the nozzle N.

As illustrated in FIG. 2 and FIG. 3, the case 42 is installed on the surface of the negative side of the Z direction among the communication plate 32. For example, the case 42 is a structure which is integrally molded by an ejection molding of a resin material. As illustrated in FIG. 3, an accommodation unit 422 and an introduction hole 424 are formed in the case 42 of the first embodiment. The accommodation unit 422 is a concave unit having an outer shape correlating with the opening unit 322 of the communication plate 32 in the planar view, and the introduction hole 424 is a through hole communicating with the accommodation unit 422. As understood from FIG. 3, the opening unit 322 of the communication plate 32 and the accommodation unit 422 of the case 42 communicate with each other, and the space functions as a liquid storage chamber (reservoir) R. The ink passing through the introduction hole 424 which is supplied from the liquid container 14, is stored in the liquid storage chamber R. The compliance unit 48 of FIG. 2 and FIG. 3, is an element for absorbing a pressure change of the liquid storage chamber R, and includes, for example, a flexible sheet member.

Specifically, the compliance unit 48 is installed on the surface of the positive side of the Z direction among the communication plate 32, so as to configure a bottom plane of the liquid storage chamber R by blocking the opening unit 322 of the communication plate 32, each branch path 328, and each supply hole 324.

As understood from FIG. 2 and FIG. 3, the vibration plate 36 is stacked on the surface of the opposite side to the communication plate 32 among the pressure chamber substrate 34. That is, each space S of the pressure chamber substrate 34 is sealed by the vibration plate 36. The vibration plate 36 of the first embodiment is a flat plate which is elastically vibratile. For example, the vibration plate 36 is configured by stacking an elastic film which formed of an elastic material such as a silicon oxide, and an insulating film which formed of an insulating material such as a zirconium oxide.

As understood from FIG. 3, the vibration plate 36 and the communication plate 32 are positioned counter to each other by interposing each space S of the pressure chamber substrate 34 therebetween, and thereby, a pressure chamber C of using the vibration plate 36 as an upper plane and the communication plate 32 as a lower plane is formed. As understood from the above description, the ink which is stored in the liquid storage chamber R, is parallelly supplied to each pressure chamber C by branching off into the plurality of branch paths 328, and passing through the supply hole 324, and each pressure chamber C is filled with the ink. The ink is ejected to the outside by passing through the communication hole 326 and the nozzle N from the pressure chamber C depending on the vibration of the vibration plate 36. Since the full lengths of the first space S1 and the second space S2 are different from each other in the Y direction, volumes of the pressure chamber C correlating with the first space S1 and the pressure chamber C correlating with the second space S2 are different from each other. Specifically, the volume of the pressure chamber C correlating with the first space S1 is greater than the volume of the pressure chamber C correlating with the second space S2.

In a configuration (referred to as "Comparative Example", hereinafter) that the plurality of nozzles N are arrayed into one array along the X direction, since the interval between the nozzles N which are adjacent to each other is excessively narrow (density of the plurality of nozzles N is excessively high), an air current which caused by the ejection of the ink due to each nozzle N has an influence on the ink which is ejected from another nozzle N, and a phenomenon (ripple mark phenomenon) that the printing density becomes uneven within the plane of the medium 12 as a ripple mark, may be generated. In the first embodiment, since the positions at the first end EA are different from each other in the first space S1 and the second space S2, regardless of the configuration that the plurality of pressure chambers C are densely arranged along the X direction, it is possible to secure the interval between the respective nozzles N to a degree that the ripple mark phenomenon is prevented. Moreover, in Comparative Example, since the plurality of communication holes 326 are densely arrayed into one array along the X direction, a plate thickness of a partition wall between the respective communication holes 326 which are adjacent to each other in the X direction among the communication plate 32 is sufficiently thin. Therefore, there is a problem (so-called crosstalk) that the internal pressure change of each communication hole 326 is propagated to the adjacent communication hole 326 through the partition wall. In the first embodiment, the Y direction position of the communication hole 326 correlating with the first space S1 and the Y direction position of the communication hole 326 correlating with the second space S2 are different from each other. That is, the interval between the respective communication holes 326 is enlarged in comparison with Comparative Example. Therefore, there is an advantage that the above-described problem of propagating the internal pressure change of the communication hole 326 to the adjacent communication hole 326 may be reduced.

Figure 6:
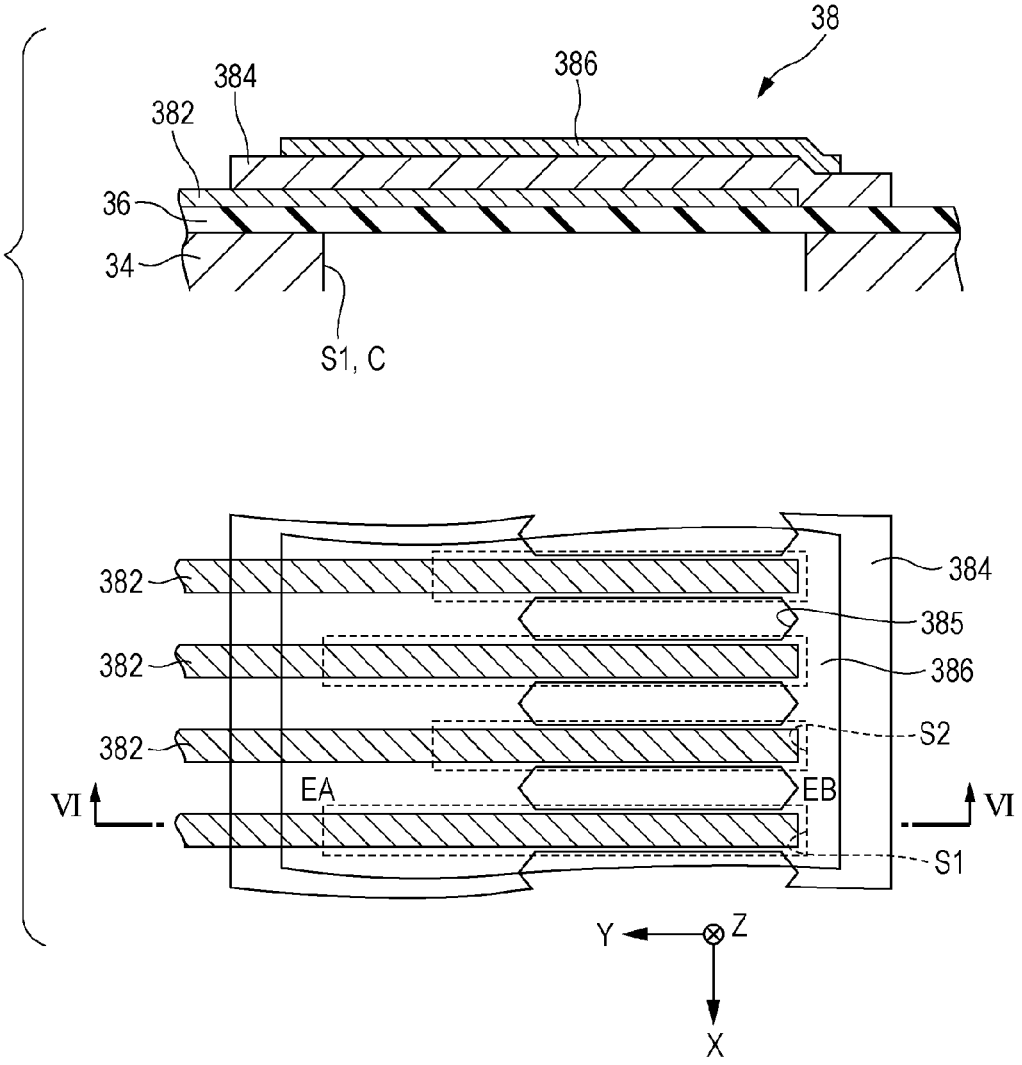
FIG. 6 is a plan view and a sectional view illustrating a configuration of a piezoelectric element.

As illustrated in FIG. 2, a plurality of piezoelectric elements 38 are formed on the surface of the opposite side to the pressure chamber substrate 34 among the vibration plate 36. FIG. 6 is a plan view and a sectional (section taken along VI-VI line) view in a case of enlarging the surface of the opposite side to the pressure chamber substrate 34 among the vibration plate 36. As illustrated in FIG. 6, a plurality of first electrodes 382, a piezoelectric body layer 384, and a second electrode 386 are stacked on the surface of the opposite side to the pressure chamber substrate 34 among the vibration plate 36. Each of the plurality of first electrodes 382 is an individual electrode of the long shape along the Y direction which is individually formed per the space S (per the pressure chamber C) so as to overlap with the space S in the planar view, and is arrayed along the X direction at the intervals to each other.

The piezoelectric body layer 384 is a film body that covers the plurality of first electrodes 382 by being formed of a piezoelectric material so as to continue throughout the plurality of spaces S. The piezoelectric body layer 384 of the first embodiment is formed throughout the positive side position of the Y direction when seen from the first end EA of each space S, and the negative side position of the Y direction when seen from the second end EB of each space S. A notch (slit) 385 which is extended along the Y direction, is formed in the position of the interval between the respective first electrodes 382 which are adjacent to each other among the piezoelectric body layer 384 in the planar view.

The second electrode 386 is a common electrode that covers the plurality of first electrodes 382 and the piezoelectric body layer 384 by being formed so as to continue throughout the plurality of spaces S. A region where the first electrode 382, the piezoelectric body layer 384, and the second electrode 386 overlap with each other in the planar view, functions as a piezoelectric element 38. That is, the piezoelectric element 38 which is configured by the first electrode (lower electrode) 382, the piezoelectric body layer 384, and the second electrode (upper electrode) 386, is formed on the surface of the vibration plate 36 per the pressure chamber C. Each piezoelectric element 38 is displaced depending on a drive signal which is supplied to the first electrode 382 from an external apparatus. The pressure of the pressure chamber C is changed by the vibration of the vibration plate 36 which is coupled with the displacement of the piezoelectric element 38, and thereby, the ink filling in the pressure chamber C is ejected to the outside from the nozzle N by passing through the communication hole 326. Since the notch 385 is formed between the respective piezoelectric elements 38 which are adjacent to each other, the propagation of the vibration throughout the piezoelectric elements 38 which are adjacent to each other is suppressed.

The protection member 44 of FIG. 2 and FIG. 3, is a flat plate-shaped structure for protecting each piezoelectric element 38, and is stacked in the vibration plate 36 by being integrally formed, for example, due to the ejection molding of the resin material. The protection member 44 of the first embodiment is fixed to the vibration plate 36 so as to cover the plurality of piezoelectric elements 38, for example, by using the adhesive. As illustrated in FIG. 3, a space (referred to as "accommodation space", hereinafter) V is formed on the surface of the vibration plate 36 side among the protection member 44.

As illustrated in FIG. 3, the protection member 44 includes a flat plate-shaped covering unit 442 that covers the plurality of piezoelectric elements 38, and a frame-shaped joining unit 444 protruding from the periphery of the covering unit 442 toward the vibration plate 36 side. By fixing the surface of the joining unit 444 to the vibration plate 36, the covering unit 442 is positioned counter to the vibration plate 36 at a predetermined interval. That is, the joining unit 444 of the protection member 44 functions as a leg unit which supports the covering unit 442. The space (dent) of using the surface of the covering unit 442 as a bottom plane by being surrounded with an inner peripheral plane of the joining unit 444, is the accommodation space V. The accommodating space V of the first embodiment is formed into a rectangular shape that encloses the plurality of piezoelectric elements 38 which are formed on the surface of the vibration plate 36 in the planar view. Each piezoelectric element 38 is displaced depending on the drive signal, in a state of being accommodated in the accommodation space V.

Figure 7:
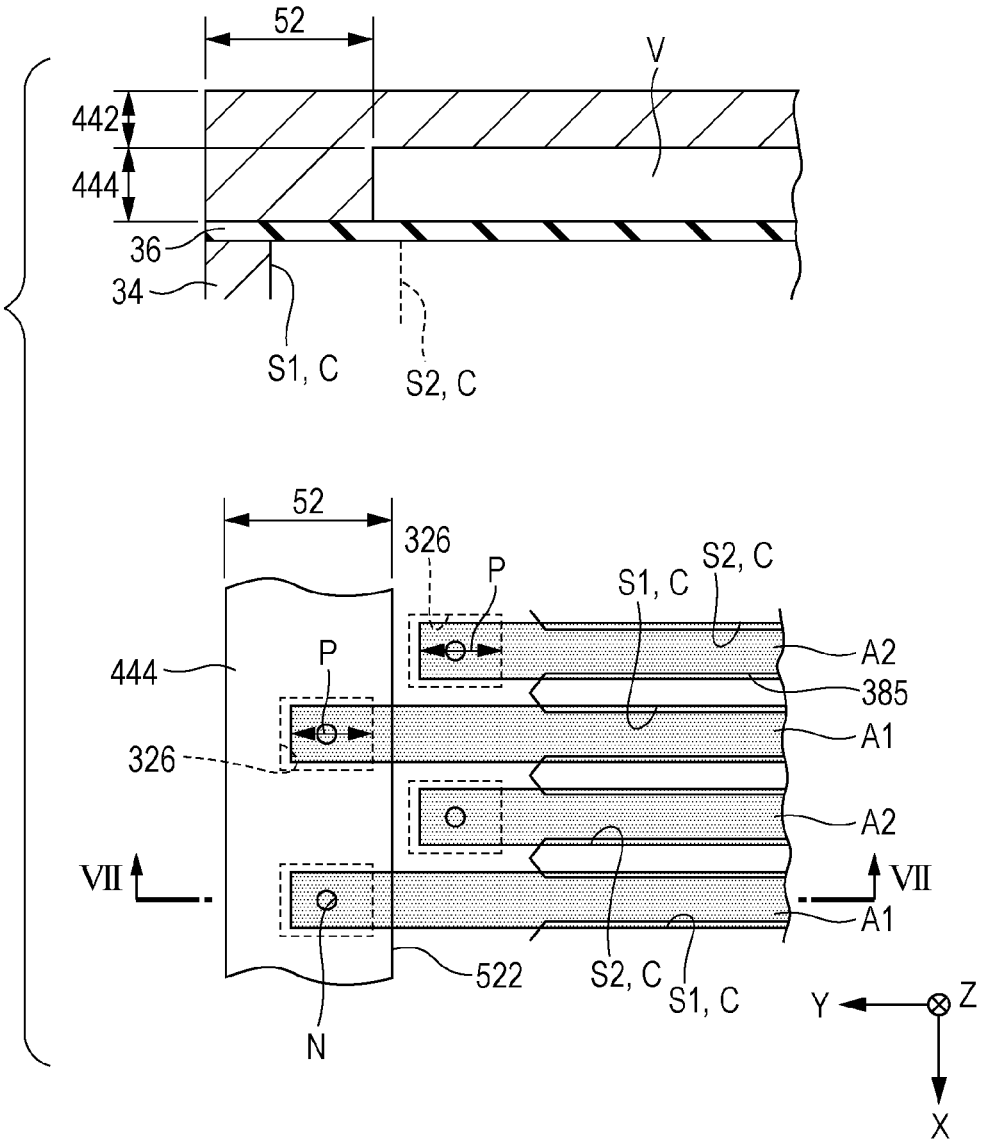
FIG. 7 is a plan view and a sectional view illustrating a relationship between a supporting unit and each space.

As illustrated in FIG. 3, the joining unit 444 of the protection member 44 according to the first embodiment includes a portion (referred to as "supporting unit", hereinafter) 52 which is positioned on the positive side of the Y direction in the planar view and is extended along the X direction. FIG. 7 is a plan view and a sectional (section taken along VII-VII line) view illustrating a relationship between the supporting unit 52 of the protection member 44 and each space S (each pressure chamber C) of the pressure chamber substrate 34. Furthermore, the illustration of each piezoelectric element 38 is conveniently omitted in FIG. 7.

As illustrated in FIG. 7, the supporting unit 52 of the first embodiment is arranged so as to overlap with the end unit P of the first end EA side in each first space S1 in the planar view, and not to overlap with the end unit P of each second space S2. That is, the supporting unit 52 is extended along the X direction so as to continue throughout the end units P of the plurality of first spaces S1, and a margin (inner peripheral plane) 522 of the supporting unit 52 is extended into the straight line shape along the X direction between the end unit P of each first space S1 and the end unit P of each second space S2. Furthermore, each notch 385 of the piezoelectric body layer 384 is positioned on the negative side of the Y direction when seen from the margin 522 of the supporting unit 52.

A region (referred to as "counter region", hereinafter) A which overlaps with each space S among the vibration plate 36 in the planar view is conveniently illustrated by a mesh in FIG. 7. A counter region A1 is a region which overlaps with the first space S1, and a counter region A2 is a region which overlaps with the second space S2 in FIG. 7. Since the supporting unit 52 is fixed to the surface of the vibration plate 36, the vibration is suppressed in the region which overlaps with the supporting unit 52 among each counter region A of the vibration plate 36 in the planar view, in comparison with the region which does not overlap with the supporting unit 52 among the counter region A. In the first embodiment, since the supporting unit 52 of the protection member 44 overlaps with the end unit P of the first end EA side among the first space S1 as described above, the portion correlating with the end unit P among the counter region A1 correlating with the first space S1 is restrained by the supporting unit 52, and the vibration is suppressed thereat. That is, the vibration of the region which overlaps with the supporting unit 52 is suppressed by the supporting unit 52, and only the region which does not overlap with the supporting unit 52 is vibrated as being coupled with the piezoelectric element 38 in the counter region A1 correlating with the first space S1 among the vibration plate 36, in contrast with the case where the counter region A2 correlating with the second space S2 is vibrated throughout the whole region as being coupled with the piezoelectric element 38. As understood from the above description, the partial region which is defined by the supporting unit 52 selectively functions as a vibration region in the counter region A1, in contrast with the case where the whole of the counter region A2 functions as a vibration region (region which is actually vibrated). The capacity of the first space S1 is greater than the capacity of the second space S2 as described above, but the vibration of the counter region A1 among the vibration plate 36 is partially suppressed by the supporting unit 52 of the protection member 44, and thereby, a change amount (excluded volume) of the volume of the pressure chamber C by the vibration of the vibration plate 36, is adjusted to be almost the same in the first space S1 and the second space S2.

As described above, in the first embodiment, the supporting unit 52 of the protection member 44 is stacked in the vibration plate 36 so as to overlap with the end unit P of the first end EA side of the first space S1 in the planar view, and thereby, the vibration of the counter region A1 is partially suppressed among the vibration plate 36. Therefore, there is the advantage that the flow path properties (for example, the excluded volume described above) of each pressure chamber C may be suppressed by the simple configuration, in comparison with the technology of JP-A-2011-140173 of adjusting the flow path properties of each pressurized liquid chamber by making the positions of the narrowing units be different from each other within the flow path.

Moreover, in the first embodiment, the positions at the second end EB are common in each of the first space S1 and the second space S2. That is, the second end EB of each first space S1 and the second end EB of each second space S2 are positioned on the straight line which is parallel to the X direction. Therefore, there is the advantage that the structure of the flow path for supplying the ink to each space S may be simplified, in comparison with the configuration of making the positions at the second end EB be different from each other in the first space S1 and the second space S2. For example, the plurality of supply holes 324 of the communication plate 32 may be arrayed into the straight line shape in the X direction, and the full lengths of the plurality of branch paths 328 may be the same. Still more, for example, there is the advantage that a bubble which is mixed into the ink is easily discharged to the outside, by simplify the structure of the flow path.

Furthermore, if the positions at the first end EA are different from each other in the first space S1 and the second space S2 on the basis of the configuration that the positions at the second end EB are common in the first space S1 and the second space S2 as described above, since a difference between the volumes of the first space S1 and the second space S2 becomes apparent, the difference between the flow path properties of the first space S1 and the second space S2 may be particularly a problem. In the first embodiment, since the vibration of the vibration plate 36 is suppressed by that the supporting unit 52 of the protection member 44 overlaps with the end unit P of the first space S1, it is possible to adjust the flow path properties (for example, the excluded volume) of each pressure chamber C to be almost the same by the simple configuration, even in the configuration that the difference between the volumes of the first space S1 and the second space S2 is remarkable as described above.

In the first embodiment, the protection member 44 for protecting the piezoelectric element 38 is used as a unit (vibration restraint unit) that suppresses the vibration of the vibration plate 36. Therefore, there is the advantage that the configuration of the liquid ejecting head 100 is simplified (for example, the number of components is reduced), in comparison with the case of installing an element which is dedicated to suppressing the vibration of the vibration plate 36.

Second Embodiment

A second embodiment of the invention will be described. Each detailed description of the elements of which effects and functions are the same as the first embodiment in each embodiment illustrated hereinafter, will be appropriately omitted by using the signs which are used in the description of the first embodiment.

Figure 8:
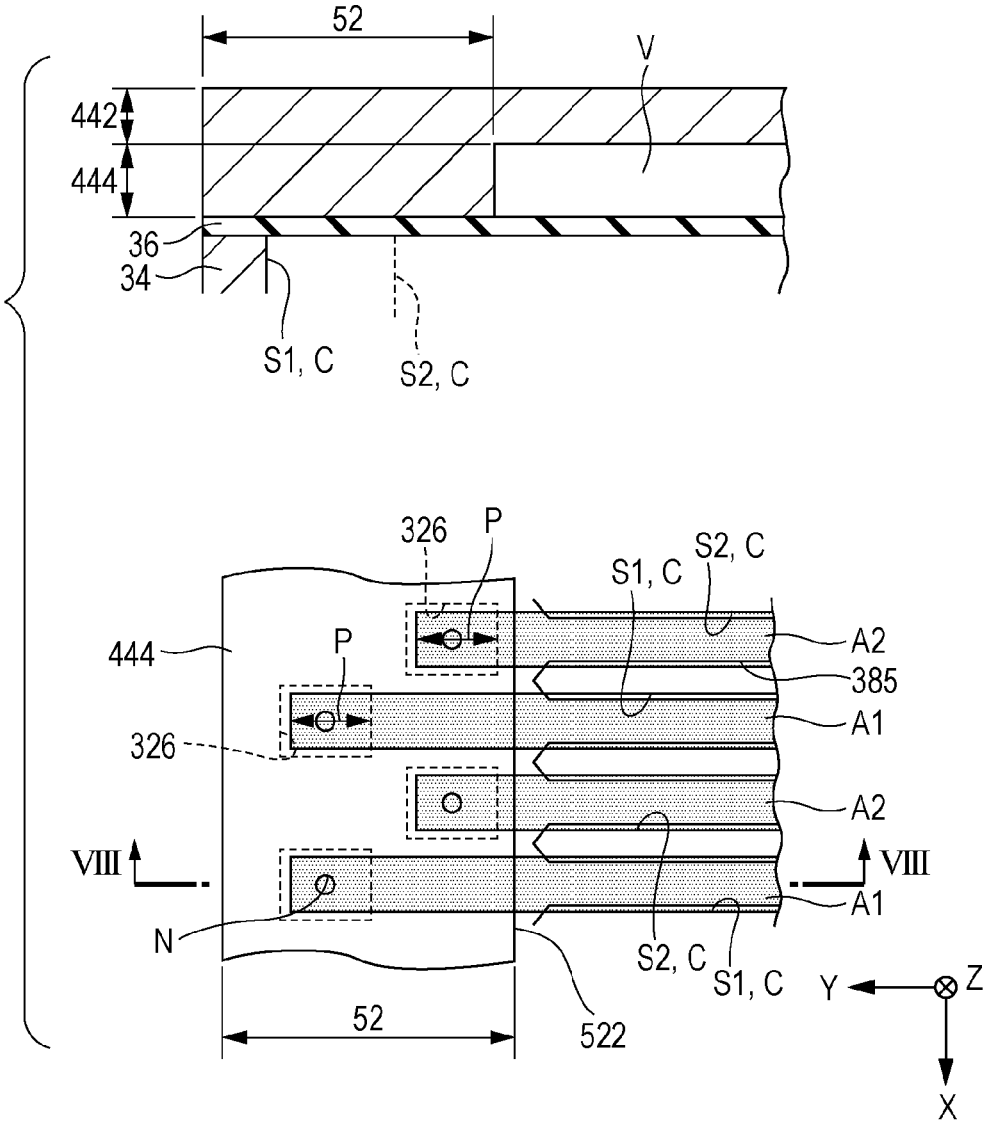
FIG. 8 is a plan view and a sectional view illustrating a relationship between a supporting unit and each space in a second embodiment.

FIG. 8 is a plan view and a sectional (section taken along VIII-VIII line) view illustrating a relationship between the supporting unit 52 of the protection member 44 and each space S of the pressure chamber substrate 34 in the second embodiment. As illustrated in FIG. 8, the supporting unit 52 of the protecting member 44 of the second embodiment is arranged so as to overlap with the end unit P of the first end EA side in both of the first space S1 and the second space S2 in the planar view. That is, the margin 522 of the supporting unit 52 is extended into the straight line shape along the X direction in the negative side position of the Y direction when seen from each end unit P of the first space S1 and the second space S2. As understood from FIG. 8, an area of the region which overlaps with the supporting unit 52 among the first space S1 in the planar view is greater than an area of the region which overlaps with the supporting unit 52 among the second space S2.

In the above configuration, the vibration of the portion including the end unit P of the first end EA side is also suppressed by the supporting unit 52 in the counter region A2 correlating with the second space S2, in addition to that the vibration of the portion including the end unit P among the counter region A1 correlating with the first space S1 is suppressed by the supporting unit 52 in the same manner as the first embodiment. That is, the vibration region is defined by the supporting unit 52 in both of the counter region A1 and the counter region A2.

In the second embodiment, the same effects as the first embodiment are realized. Moreover, in the second embodiment, since the supporting unit 52 is repeated in both of the first space S1 and the second space S2, it is possible to make conditions of the vibration of the vibration plate 36 be similar to each other in the first space S1 and the second space S2, in comparison with the first embodiment where the counter region A2 is not influenced by the supporting unit 52 while the vibration of the counter region A1 is suppressed by the supporting unit 52. Therefore, there is the advantage that each pressure chamber C is highly accurately controlled into the same flow path properties (for example, the excluded volume), in comparison with the first embodiment.

Third Embodiment

Figure 9:
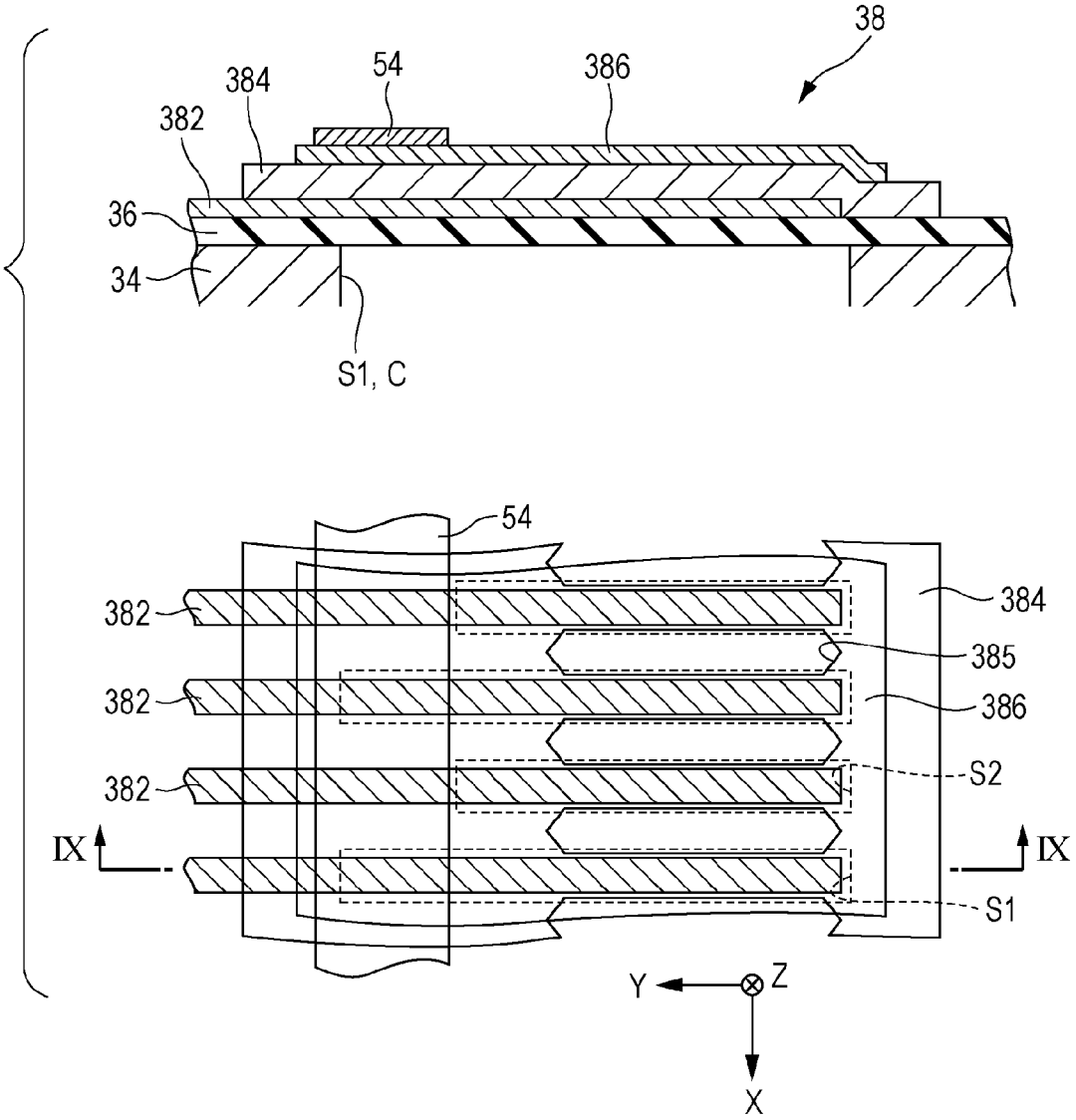
FIG. 9 is a plan view and a sectional view illustrating a metal layer in a third embodiment.

FIG. 9 is a plan view and a sectional (section taken along IX-IX line) view which are obtained by enlarging the surface of the vibration plate 36 in a third embodiment. As illustrated in FIG. 9, in the third embodiment, in addition to the plurality of first electrodes 382, the piezoelectric body layer 384, and the second electrode 386, a metal layer 54 is formed on the plane of the vibration plate 36. The metal layer 54 is a conductive film that is stacked in the second electrode 386. Specifically, the metal layer 54 is extended into the straight line shape (belt shape) along the X direction so as to cover the periphery of the positive side of the Y direction among the second electrode 386. Although the material of the metal layer 54 is arbitrary, for example, a single substance metal such as gold (Au) or nichrome (NiCr), or an alloy containing such the metal is suitably adopted as a material of the metal layer 54. Moreover, although the manufacturing method of the metal layer 54 is arbitrary, for example, it is possible to form the metal layer 54 into a film thickness of 50 nm or more by a known film forming method such as a sputtering. Since the metal layer 54 is stacked in the second electrode 386 in the third embodiment as described above, the influence of the resistance of the second electrode 386 is reduced. From a viewpoint of realizing the above effects, the configuration of forming the metal layer 54 by the conductive material of the low resistance in comparison with the second electrode 386 is suitable.

Figure 10:
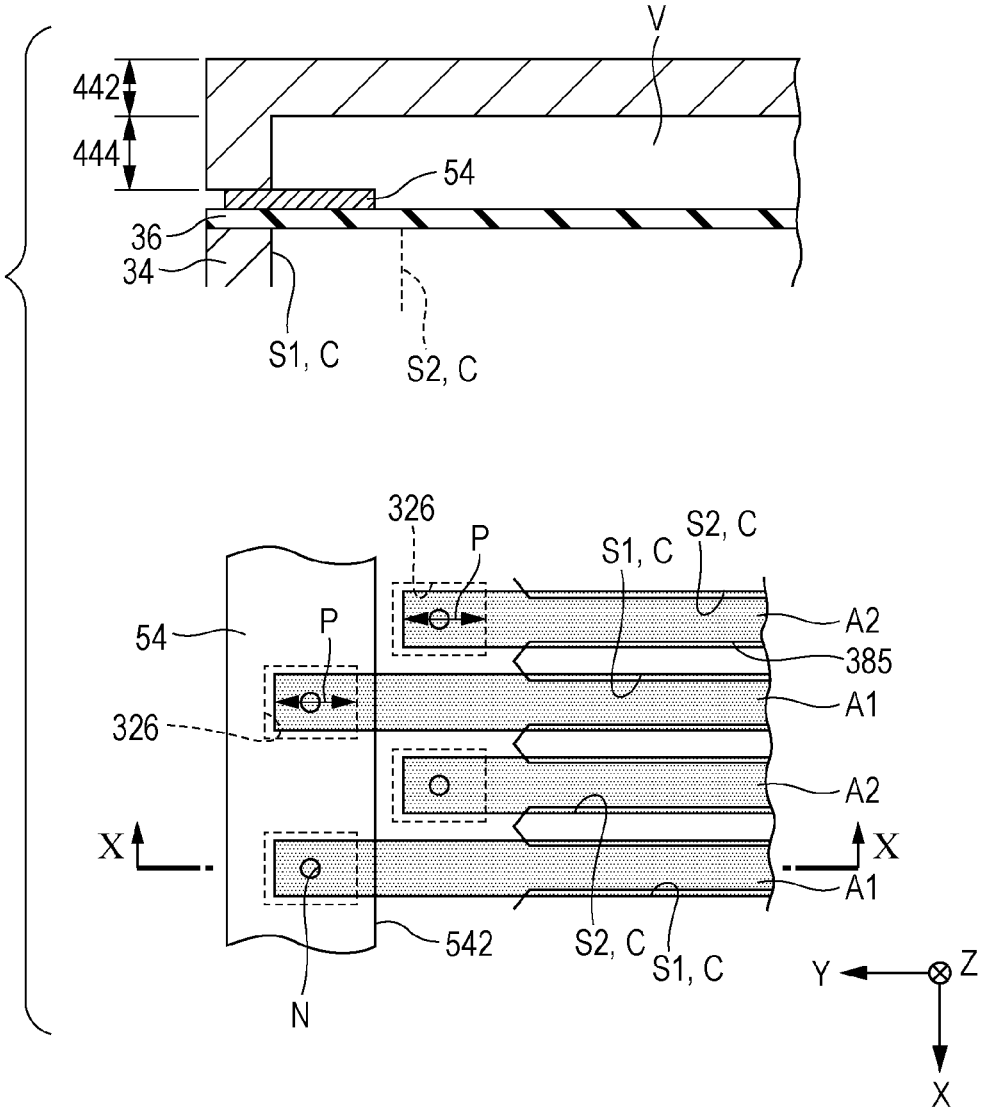
FIG. 10 is a plan view and a sectional view illustrating a relationship between the metal layer and each space in the third embodiment.

FIG. 10 is a plan view and a sectional (section taken along X-X line) view illustrating a relationship between the metal layer 54 and each space S in the third embodiment. As illustrated in FIG. 10, the metal layer 54 of the third embodiment is formed so as to overlap with the end unit P of the first end EA side in each first space S1 in the planar view, and not to overlap with the end unit P of each second space S2, in the same manner as the supporting unit 52 of the first embodiment. That is, a margin 542 on the negative side of the Y direction among the metal layer 54 is extended into the straight line shape along the X direction between the end unit P of each first space S1 and the end unit P of each second space S2. On the other hand, the supporting unit 52 of the protection member 44 of the third embodiment does not overlap with any of the first space S1 and the second space S2 in the planar view. That is, the margin 522 of the supporting unit 52 is positioned on the positive side of the Y direction when seen from each first end EA of the first space S1 and the second space S2.

In the third embodiment, since the metal layer 54 overlaps with the end unit P of the first space S1, the portion correlating with the end unit P among the counter region A1 correlating with the first space S1 is restrained by the metal layer 54, and thereby, the vibration is suppressed. That is, the metal layer 54 functions as a sinker (deadweight) for suppressing the vibration of the counter region A1. As understood from the above description, in the third embodiment, the partial region which is defined by the metal layer 54 selectively functions as a vibration region in the counter region A1 correlating with the first space S1, in contrast with the case where the whole of the counter region A2 functions as a vibration region, in the same manner as the first embodiment. Therefore, the same effects as the first embodiment are also realized in the third embodiment. Moreover, since there is no need of using the protection member 44 for suppressing the vibration of the vibration plate 36 in the third embodiment, there is the advantage that the freedom degrees of the shape and the dimension of the protection member 44 are increased in comparison with the first embodiment.

Fourth Embodiment

Figure 11:
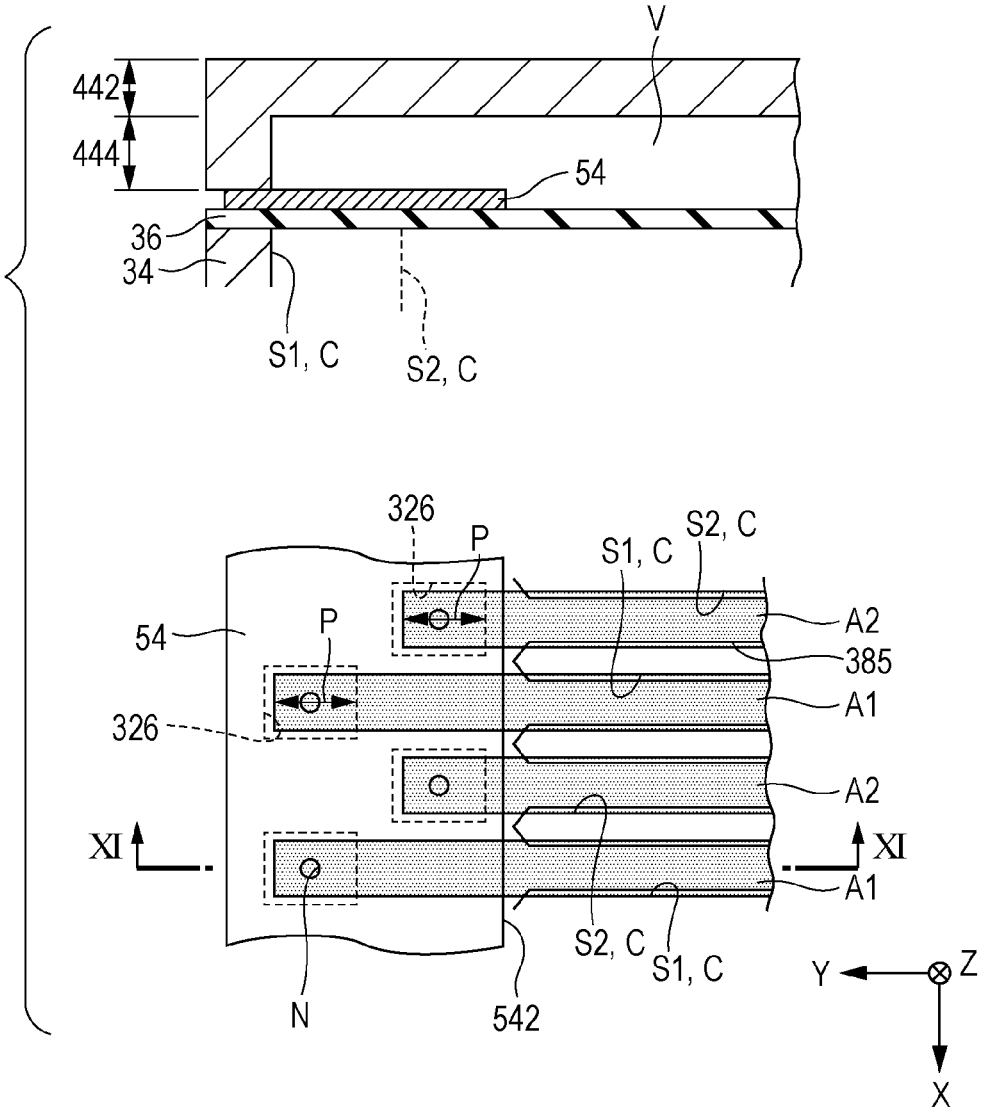
FIG. 11 is a plan view and a sectional view illustrating a relationship between a metal layer and each space in a fourth embodiment.

The liquid ejecting head 100 of a fourth embodiment includes the metal layer 54 which is stacked in the second electrode 386, in the same manner as the third embodiment. FIG. 11 is a plan view and a sectional (section take along XI-XI line) view illustrating a relationship between the metal layer 54 and each space S in the fourth embodiment. As understood from FIG. 11, the metal layer 54 of the fourth embodiment is arranged so as to overlap with the end unit P in both of the first space S1 and the second space S2 in the planar view. That is, the margin 542 of the metal layer 54 is extended into the straight line shape along the X direction on the negative side of the Y direction when seen from each end unit P of the first space S1 and the second space S2. As understood from FIG. 11, the area of the region which overlaps with the metal layer 54 among the first space S1 in the planar view is greater than the area of the region which overlaps with the metal layer 54 among the second space S2.

In the above configuration, the vibration of the portion including the end unit P is also suppressed by the metal layer 54 in the counter region A2 correlating with the second space S2, in addition to that the vibration of the portion including the end unit P among the counter region A1 correlating with the first space S1 is suppressed by the metal layer 54 in the same manner as the third embodiment. That is, the vibration region is defined by the metal layer 54 in both of the counter region A1 and the counter region A2.

In the fourth embodiment, the same effects as the third embodiment are realized. Moreover, in the fourth embodiment, since the metal layer 54 is repeated in both of the first space S1 and the second space S2, it is possible to make the conditions of the vibration of the vibration plate 36 be similar to each other in the first space S1 and the second space S2, in the same manner as the second embodiment. Therefore, there is the advantage that each pressure chamber C is highly accurately controlled into the same flow path properties, in comparison with the third embodiment.

Fifth Embodiment

Figure 12:
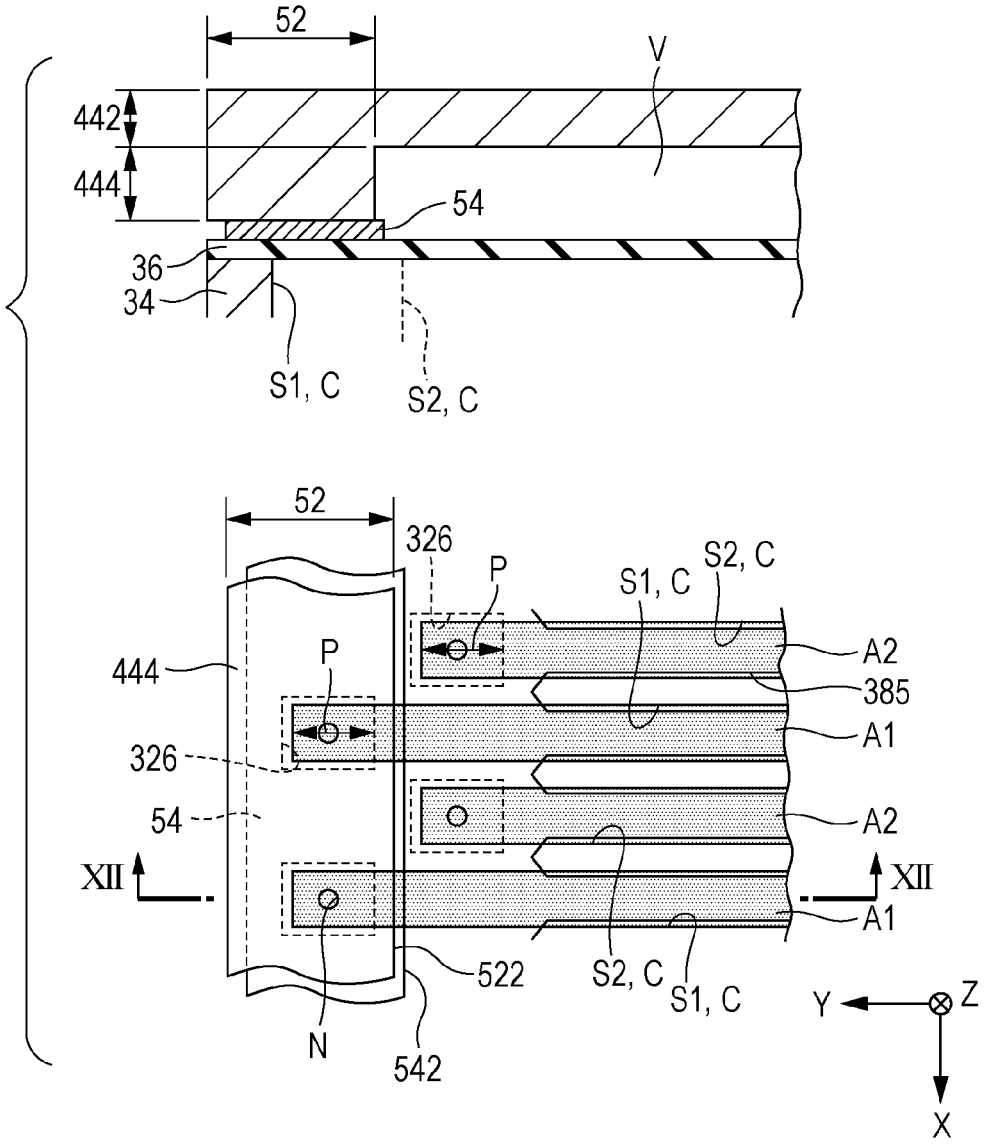
FIG. 12 is a plan view and a sectional view illustrating a supporting unit and a metal layer in a fifth embodiment.

A fifth embodiment is an embodiment in which both of the supporting unit 52 (FIG. 7) of the first embodiment and the metal layer 54 (FIG. 10) of the third embodiment are installed. FIG. 12 is a plan view and a sectional (section taken along XII-XII line) view illustrating a relationship between the supporting unit 52, the metal layer 54 and each space S of the pressure chamber substrate 34 in the fifth embodiment. As illustrated in FIG. 12, in the fifth embodiment, both of the supporting unit 52 which configures the protection member 44 and the metal layer 54 which is stacked in the second electrode 386 overlap with the end unit P of the first end EA side among each first space S1 in the planar view. Therefore, the same effects as the first embodiment and the third embodiment are realized therein. Moreover, according to the fifth embodiment, there is the advantage that the vibration of the counter region A1 among the vibration plate 36 may be sufficiently suppressed, in comparison with the first embodiment in which only the supporting unit 52 overlaps with the first space S1, and the third embodiment in which only the metal layer 54 overlaps with the first space S1.

Sixth Embodiment

Figure 13:
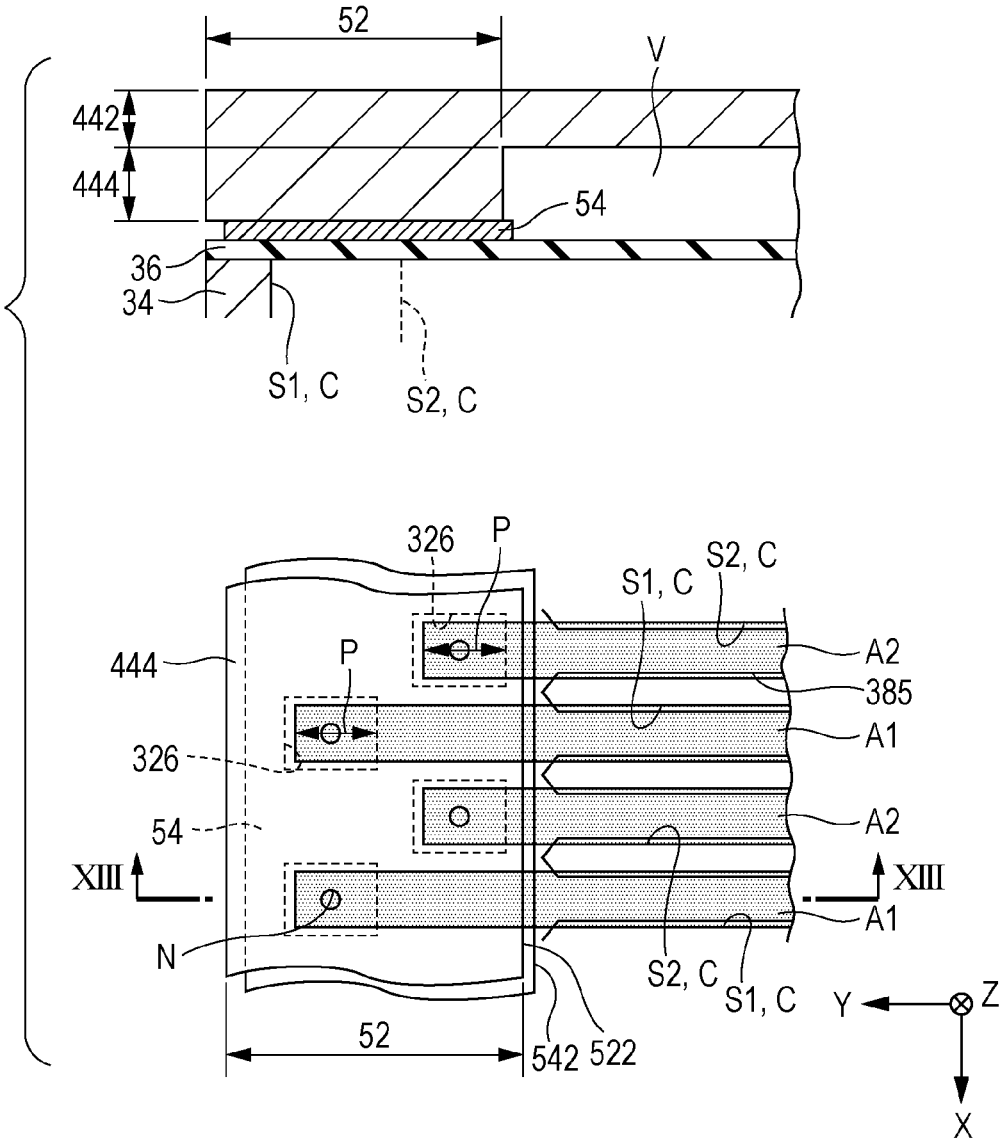
FIG. 13 is a plan view and a sectional view illustrating a supporting unit and a metal layer in a sixth embodiment.

A sixth embodiment is an embodiment in which both of the supporting unit 52 (FIG. 8) of the second embodiment and the metal layer 54 (FIG. 11) of the fourth embodiment are installed. FIG. 13 is a plan view and a sectional (section taken along XIII-XIII line) view illustrating a relationship between the supporting unit 52, the metal layer 54 and each space S of the pressure chamber substrate 34 in the sixth embodiment. As illustrated in FIG. 13, in the sixth embodiment, the supporting unit 52 and the metal layer 54 overlap with the end unit P of the first end EA side among both of the first space S1 and the second space S2 in the planar view. Therefore, the same effects as the second embodiment and the fourth embodiment are realized therein. Moreover, according to the sixth embodiment, there is the advantage that the vibration of the respective counter regions A (A1, A2) among the vibration plate 36 may be sufficiently suppressed, in comparison with the configuration that only one of the supporting unit 52 and the metal layer 54 overlaps with each space S.

Modification Example

Each embodiment illustrated above can be variously modified. Hereinafter, the specific modified aspect will be described. The aspects of two or more which are arbitrarily selected from the following examples, can be appropriately combined within the scope where the aspects are not contradictory to each other.

(1) The unit (vibration restraint unit) that suppresses the vibration of the vibration plate 36, is not limited to the supporting unit 52 or the metal layer 54 illustrated in each embodiment described above. For example, an element (adhesive layer 56, protective layer 58) illustrated hereinafter may be used as a vibration restraint unit.

(a) Adhesive Layer 56

Figure 14:
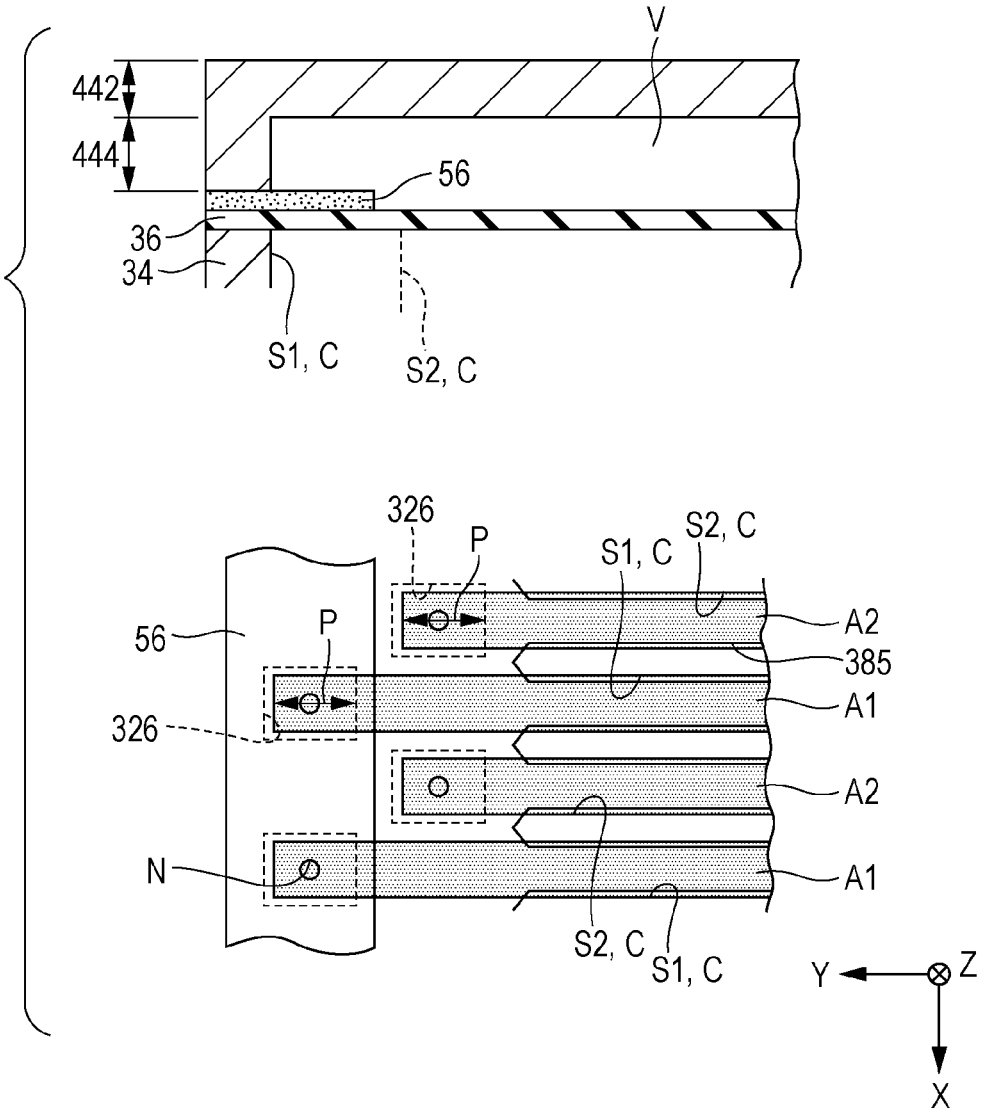
FIG. 14 is a plan view and a sectional view illustrating a relationship between an adhesive layer and each space in Modification Example.

In FIG. 14, an embodiment in which the adhesive layer 56 which is formed by an adhesive used for bonding of each element of the liquid ejecting head 100 is used as a vibration restraint unit is illustrated. The adhesive layer 56 of FIG. 14 is used for fixing the protection member 44 to the surface of the vibration plate 36. Although the material of the adhesive layer 56 is arbitrary, for example, the adhesive such as an epoxy-based adhesive or a silicon-based adhesive is suitably used. The adhesive layer 56 overlaps with the end unit P of the first end EA side among each first space S1 in the planar view, and the vibration of the region correlating with the end unit P of the first space S1 among the counter region A1 of the vibration plate 36 is suppressed. Furthermore, as understood from the examples of the second embodiment and the fourth embodiment, a configuration that the adhesive layer 56 overlaps with the end unit P of the first end EA side in both of the first space S1 and the second space S2, or a configuration that the supporting unit 52 or the metal layer 54 along with the adhesive layer 56 overlaps with one or both of the first space S1 and the second space S2 may be adopted.

(b) Protective Layer 58

Figure 15:
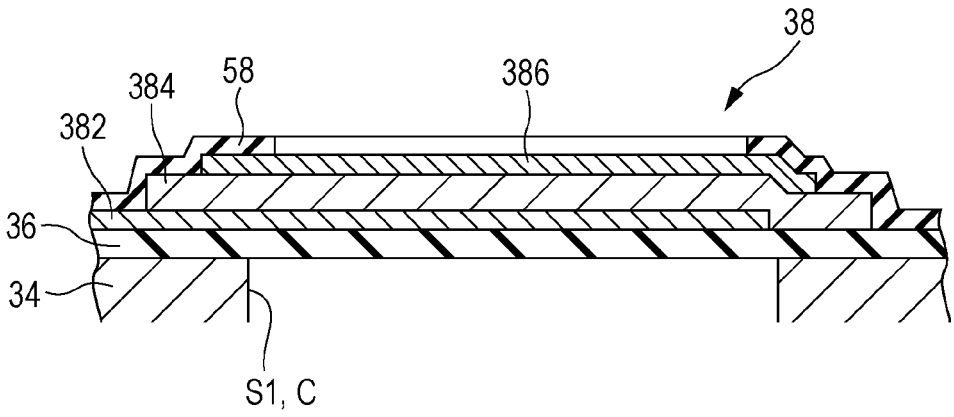
FIG. 15 is a sectional view illustrating a protective layer in Modification Example.

In FIG. 15, the protective layer 58 for protecting each piezoelectric element 38 is illustrated. The protective layer 58 of FIG. 15, is an insulating layer which is stacked in the second electrode 386 so as to overlap with the periphery portion of each piezoelectric element 38 in the planar view. For example, the protective layer 58 is formed into the film thickness of 25 nm or more by an organic material such as polyimide, or an inorganic material such as an aluminum oxide ($Al_2O_3$). The protective layer 58 overlaps with the end unit P of the first end EA side among each first space S1 in the planar view, and the vibration of the region correlating with the end unit P of the first space S1 among the counter region A1 of the vibration plate 36 is suppressed. A configuration that the protective layer 58 overlaps with the end unit P in both of the first space S1 and the second space S2, or a configuration that the supporting unit 52 or the metal layer 54 along with the protective layer 58 overlaps with the first space S1 or the second space S2 may be adopted.

As understood from the above description, the vibration restraint unit is overall expressed as an element which suppresses the partial vibration of the vibration plate 36. The supporting unit 52, the metal layer 54, the adhesive layer 56 and the protective layer 58 are examples of the vibration restraint unit. Furthermore, as understood from the examples of the fifth embodiment and the sixth embodiment, a combination of the plurality of elements may be used as a vibration restraint unit.

Figure 16:
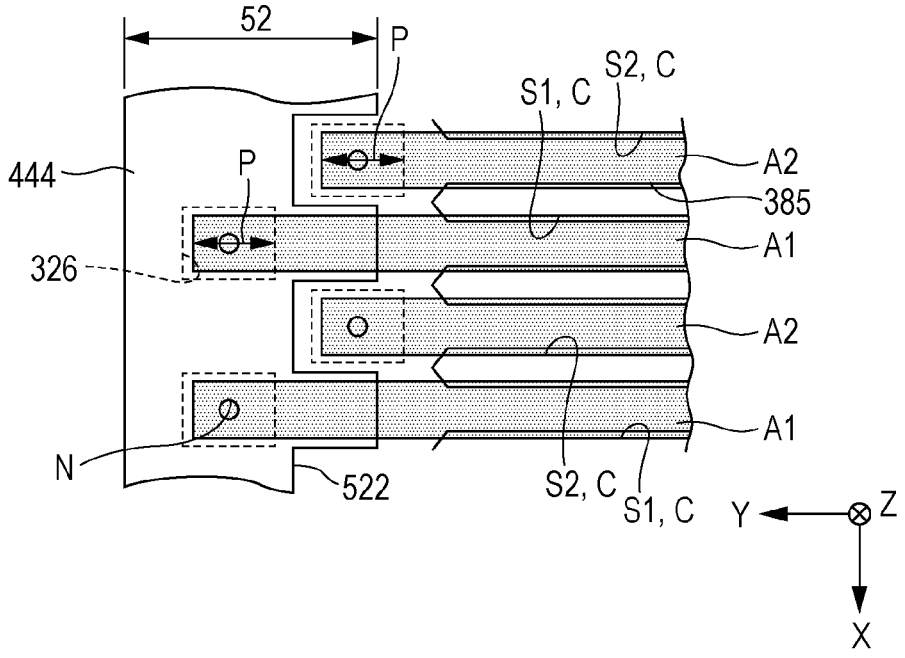
FIG. 16 is a plan view of a supporting unit in Modification Example.
Figure 17:
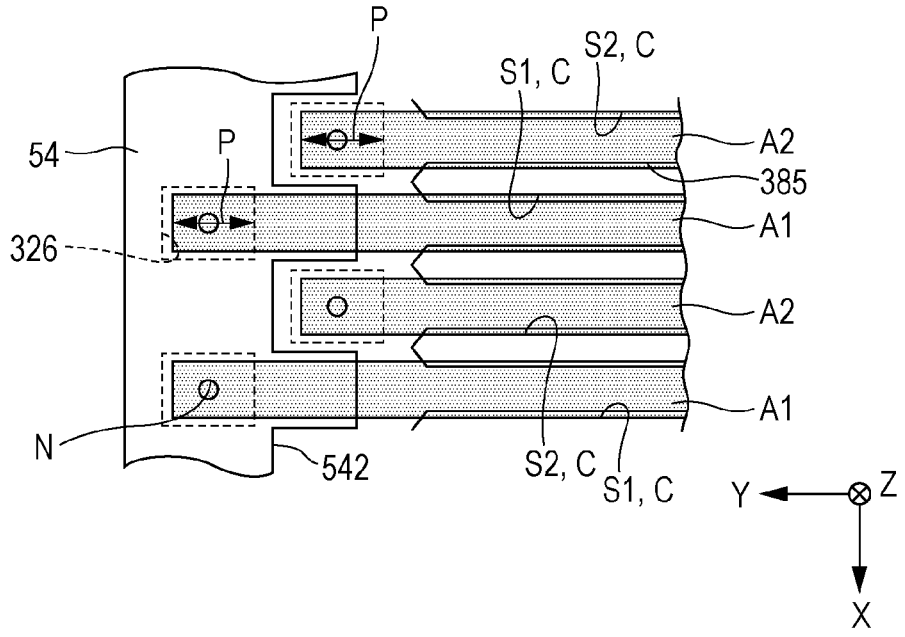
FIG. 17 is a plan view of a metal layer in Modification Example.

(2) In each embodiment described above, the configuration that the margin 522 of the supporting unit 52 of the protection member 44 is extended into the straight line shape along the X direction in the planar view is illustrated, but the planar shape of the supporting unit 52 is not limited to the above examples. For example, as illustrated in FIG. 16, a configuration that the positions at the margin 522 are different from each other per the space S in the Y direction may be adopted. Specifically, the region correlating with the first space S1 among the margin 522 of the supporting unit 52 is positioned on the negative side of the Y direction in comparison with the region correlating with the second space S2. Furthermore, the supporting unit 52 of the protecting member 44 is illustrated in the above examples, but the same configuration may be adopted in the vibration restraint unit (for example, the metal layer 54, the adhesive layer 56, the protective layer 58) other than the supporting unit 52. For example, as illustrated in FIG. 17, the positions at the margin 542 of the metal layer 54 may be different from each other per the space S.

Figure 18A:
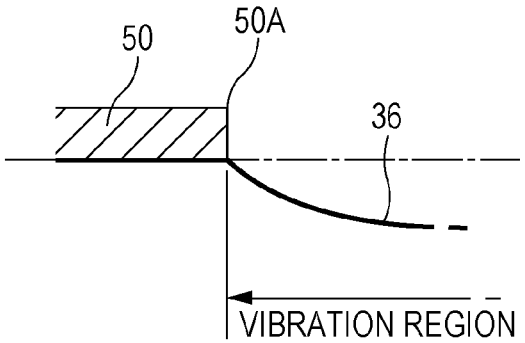
FIG. 18A and FIG. 18B are diagrams for describing a vibration region of a vibration plate.
Figure 18B:
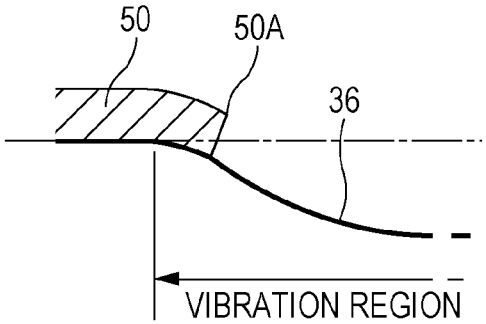

(3) As illustrated in FIG. 18A, the region of the opposite side to a vibration restraint unit 50 may be vibrated as being coupled with the piezoelectric element 38 by interposing a margin 50A (for example, the margin 522 or the margin 542) of the vibration restraint unit 50 (for example, the supporting unit 52, the metal layer 54, the adhesive layer 56, the protective layer 58) therebetween among the vibration plate 36 in the planar view. That is, the vibration region is defined by making the margin 50A of the vibration restraint unit 50 as a boundary. However, as illustrated in FIG. 18B, since the vibration restraint unit 50 along with the vibration plate 36 may be actually displaced, the case where the boundary of the vibration region does not match up the margin 50A of the vibration restraint unit 50 may be generated. As understood from the above description, the vibration region is vibrated depending on the margin 50A of the vibration restraint unit 50 throughout the plurality of spaces S among the vibration plate 36.

(4) In each embodiment described above, the vibration restraint unit is installed so as to overlap with the end unit P of the first end EA side of the first space S1 (and the second space S2) in the planar view, but in addition to the above configuration (or instead of the above configuration), it is possible to install the vibration restraint unit so that the vibration restraint unit overlaps with the end units P of the second end EB side of the first space S1 and the second space S2 in the planar view.

Figure 19:
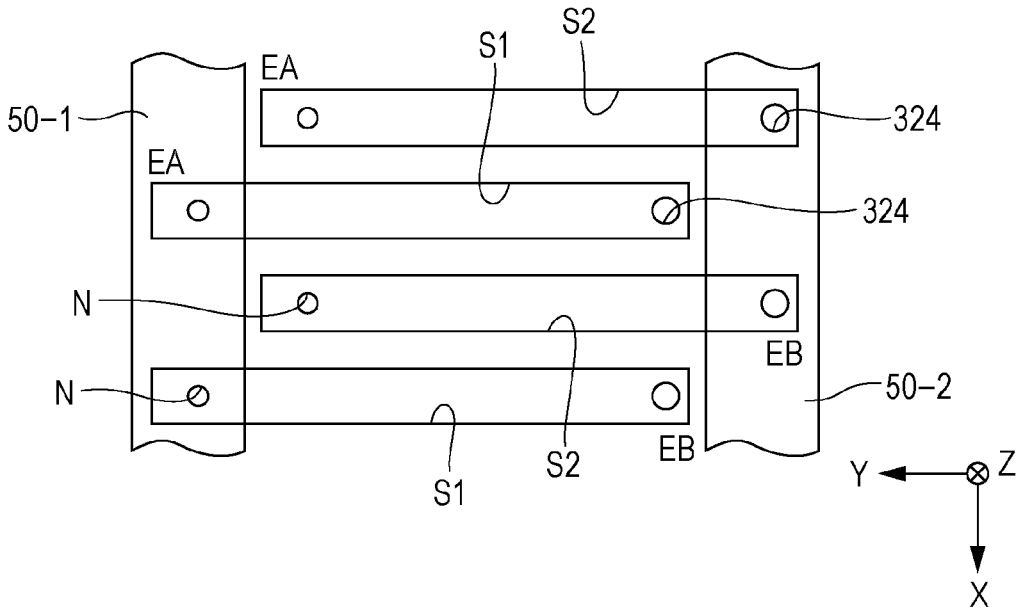
FIG. 19 is a plan view illustrating a relationship between a vibration restraint unit and each space in Modification Example.
Figure 20:
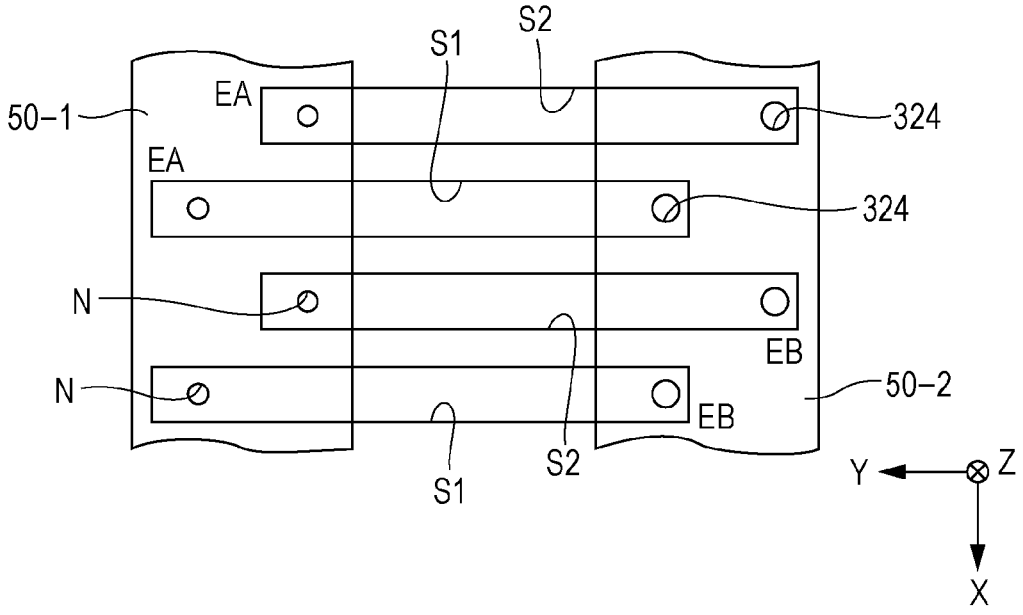
FIG. 20 is a plan view illustrating the relationship between the vibration restraint unit and each space in Modification Example.

(5) In each embodiment described above, the configuration that the positions at the second end EB in the Y direction are common in the first space S1 and the second space S2 is illustrated, but as illustrated in FIG. 19, the same configuration as each embodiment described above may be adopted even in a configuration that the positions at the second end EB in the Y direction are different from each other in the first space S1 and the second space S2. For example, as illustrated in FIG. 19, a configuration that a vibration restraint unit 50-1 is arranged so as to overlap with the end unit P of the first end EA side of each first space S1 in the planar view, and a vibration restraint unit 50-2 is arranged so as to overlap with the end unit P of the second end EB side of each second space S2 in the planar view is assumed. Moreover, as illustrated in FIG. 20, the vibration restraint unit 50-1 may be arranged so as to overlap with the end unit P of the first end EA side in both of the first space S1 and the second space S2, and the vibration restraint unit 50-2 may be arranged so as to overlap with the end unit P of the second end EB side in both of the first space S1 and the second space S2. In the configuration of FIG. 19 or FIG. 20, the intended effect of controlling the properties of each pressure chamber C by the simple configuration is certainly realized.

(6) In each embodiment described above, the first electrode (lower electrode) 382 is used as an individual electrode per the pressure chamber C, and the second electrode 386 is used as a common electrode throughout the plurality of pressure chambers C, but the first electrode 382 may be used as a common electrode throughout the plurality of pressure chambers C, and the second electrode 386 may be used as an individual electrode per the pressure chamber C. Moreover, a configuration that both of the first electrode 382 and the second electrode 386 are used as an individual electrode per the pressure chamber C may be adopted.

Figure 21:
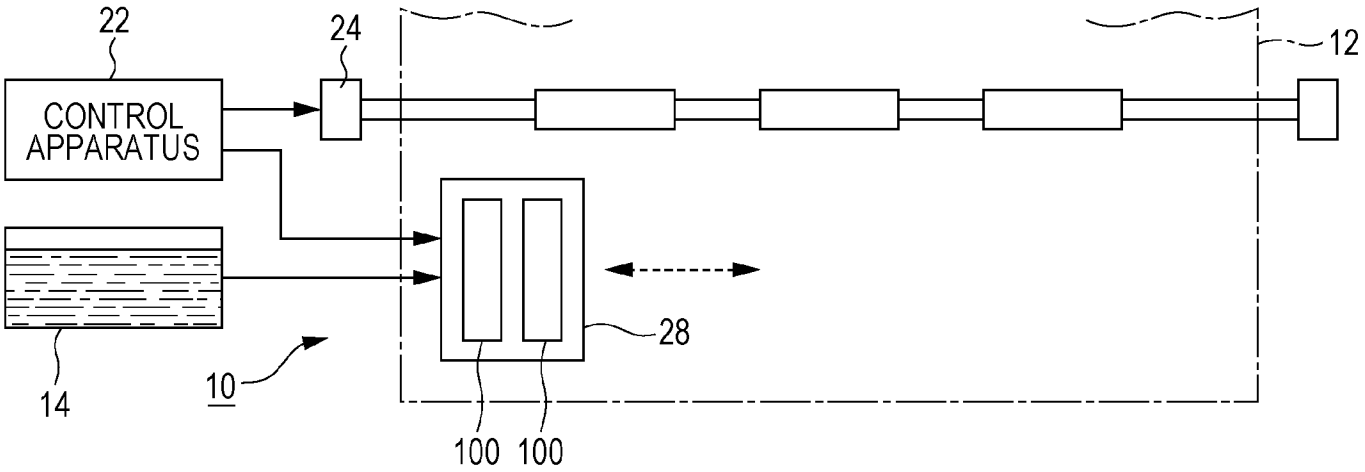
FIG. 21 is a configuration diagram of a printing apparatus according to Modification Example.

(7) In each embodiment described above, the line head where the plurality of liquid ejecting heads 100 are arrayed in the X direction perpendicular to the Y direction in which the medium 12 is transported is illustrated, but the invention can be also applied to a serial head. For example, as illustrated in FIG. 21, each liquid ejecting head 100 ejects the ink to the medium 12 while a carriage 28 to which the plurality of liquid ejecting heads 100 according to each embodiment described above are mounted reciprocates in the X direction on the basis of the control by the control apparatus 22.

(8) The printing apparatus 10 illustrated in each embodiment described above, may be adopted in various types of devices such as a facsimile apparatus and a copying machine, in addition to a device which is dedicated to printing. However, usefulness of the liquid ejecting apparatus of the invention is not limited to the printing. For example, the liquid ejecting apparatus which ejects a color material solution is used as a manufacturing apparatus which forms a color filter of a liquid crystal display apparatus. Moreover, the liquid ejecting apparatus which ejects a conductive material solution is used as a manufacturing apparatus which forms wiring or an electrode of a wiring substrate.

What is claimed is:

1. A liquid ejecting head comprising:

a pressure chamber substrate where a plurality of spaces to be a pressure chamber along a first direction are formed in a second direction which is perpendicular to the first direction;

a vibration plate that seals the space by being stacked in the pressure chamber substrate; and a piezoelectric element and a vibration restraint unit that are stacked in the vibration plate on an opposite side to the pressure chamber substrate, wherein positions at one end in the first direction are different from each other in a first space and a second space among the plurality of spaces, and the vibration restraint unit suppresses a vibration of the vibration plate by being formed so as to overlap with at least the one end side portion in the first space in a planar view.

2. The liquid ejecting head according to claim 1, wherein an excluded volume is aligned by the vibration restraint unit, in the first space and the second space.

3. A liquid ejecting apparatus comprising:

the liquid ejecting head according to claim 2.

4. The liquid ejecting head according to claim 1, wherein positions at the other end in the first direction are the same to each other, in the first space and the second space.

5. A liquid ejecting apparatus comprising:

the liquid ejecting head according to claim 4.

6. The liquid ejecting head according to claim 1, wherein the piezoelectric element includes an upper electrode, a piezoelectric body layer, and a lower electrode, and the vibration restraint unit includes a metal layer which is stacked in the upper electrode.

7. A liquid ejecting apparatus comprising:

the liquid ejecting head according to claim 6.

8. The liquid ejecting head according to claim 1, wherein the vibration restraint unit includes a protection member that has an accommodation place where the piezoelectric element is displaceable on an inside, and is stacked in the vibration plate so as to cover the piezoelectric element.

9. A liquid ejecting apparatus comprising:

the liquid ejecting head according to claim 8.

10. The liquid ejecting head according to claim 1, further comprising:

a communication plate that is stacked in the pressure chamber substrate on an opposite side to the vibration plate, and has a communication hole communicating with the space and a nozzle on the one end side, wherein a flow path diameter of the communication hole is greater than the space in the second direction, and one end of the communication hole is positioned on an outside of the space in the first direction.

11. A liquid ejecting apparatus comprising:

the liquid ejecting head according to claim 10.

12. A liquid ejecting apparatus comprising:

the liquid ejecting head according to claim 1.

* * * * *